US007988490B2

(12) United States Patent
Chen et al.

(10) Patent No.: US 7,988,490 B2
(45) Date of Patent: Aug. 2, 2011

(54) RETAINING CLIP FOR CONNECTOR

(75) Inventors: Rui-Hao Chen, Shenzhen (CN); Li Cheng, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 12/862,850

(22) Filed: Aug. 25, 2010

(65) Prior Publication Data

US 2011/0151680 A1 Jun. 23, 2011

(30) Foreign Application Priority Data

Dec. 21, 2009 (CN) ..... 2009 10 311938

(51) Int. Cl.
*H01R 13/648* (2006.01)

(52) U.S. Cl. ..... 439/607.01

(58) Field of Classification Search ..... 439/607.01, 439/575, 569, 857, 74
See application file for complete search history.

(56) References Cited

U.S. PATENT DOCUMENTS 6,216,321 B1 * 4/2001 Bakker et al. ..... 24/459
2006/0134985 A1 * 6/2006 Reed et al. ..... 439/607

* cited by examiner

*Primary Examiner* — Jean F Duverne
(74) *Attorney, Agent, or Firm* — Steven M. Reiss

(57) ABSTRACT

An exemplary retaining clip is used for holding a connector to a printed circuit board. The retaining clip includes a cover plate and a clamping plate. The cover plate includes two bent portions respectively extending from opposite sides of the cover plate. The clamping plate includes a main portion and two arms connected to the main portion. Each arm is fixed to a corresponding bent portion. The cover plate and the arms are for surrounding the connector, and the main portion is for clamping a peripheral edge of the printed circuit board.

8 Claims, 4 Drawing Sheets

RETAINING CLIP FOR CONNECTOR

BACKGROUND

1. Technical Field

The present disclosure relates to retaining clips and, particularly, to a retaining clip used for holding a connector in an electronic device.

2. Description of Related Art

Various types of data communication connectors have been developed for connecting various components together and for transmitting data therebetween. The connectors are usually disposed on a printed circuit board (PCB) by surface mounting technology (SMT).

However, over time and after repeated use, the connectors may become misaligned and no longer have a reliable connection with the PCB.

Therefore, there is room for improvement within the art.

BRIEF DESCRIPTION OF THE DRAWINGS

Many aspects of the present retaining clip can be better understood with reference to the following drawings. The components in the drawings are not necessarily drawn to scale, the emphasis instead being placed upon clearly illustrating the principles of the present retaining clip. Moreover, in the drawings, all the views are schematic, and like reference numerals designate corresponding parts throughout the several views.

DETAILED DESCRIPTION

The present retaining clip may be applied in many different electronic devices such as mobile phones, game devices, PDAs (personal digital assistants) and others. In an illustrated exemplary embodiment, the retaining clip is used in a mobile phone.

Figure 1:
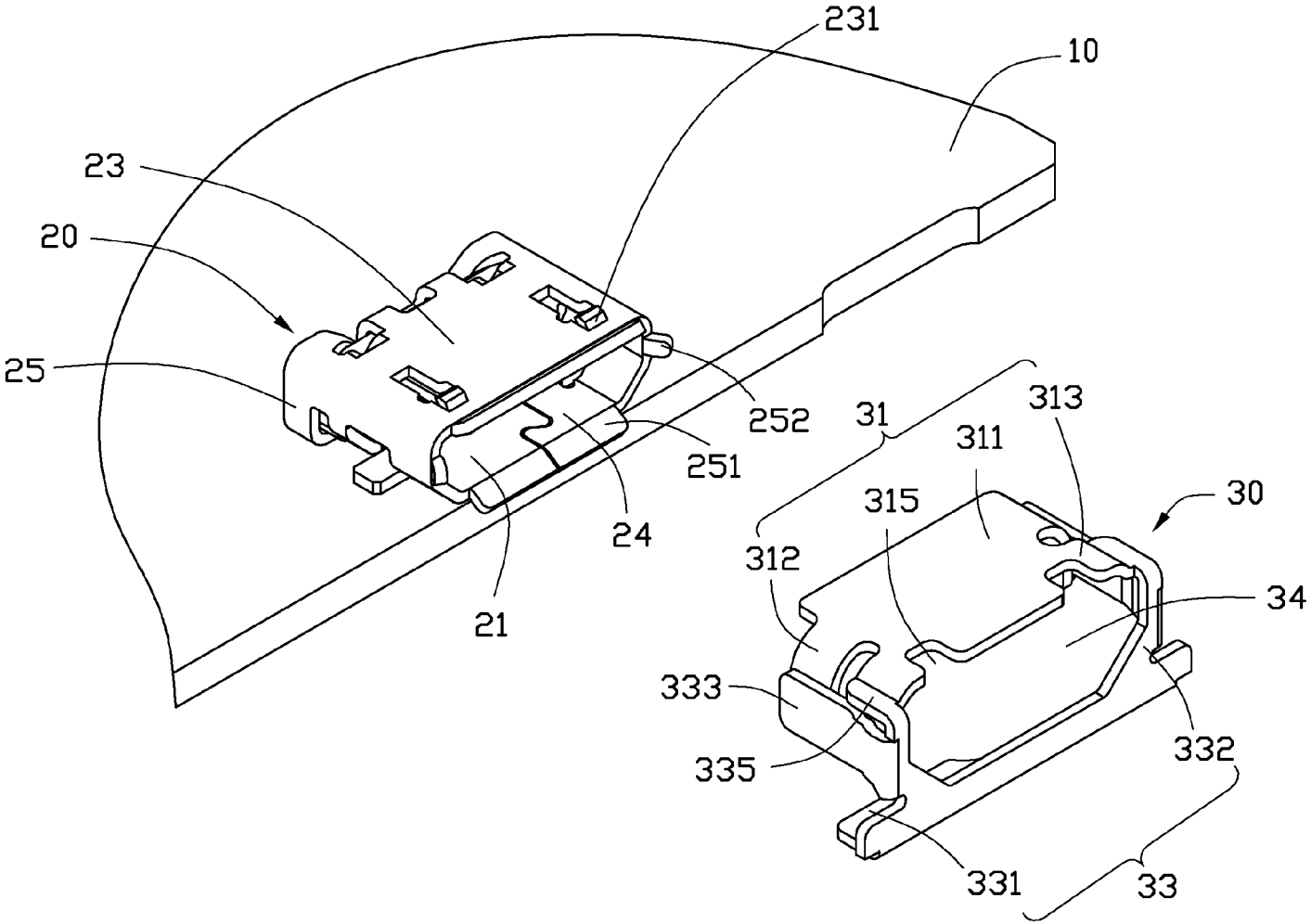
FIG. 1 is an exploded, isometric view of an electronic device using a retaining clip in accordance with an exemplary embodiment.
Figure 2:
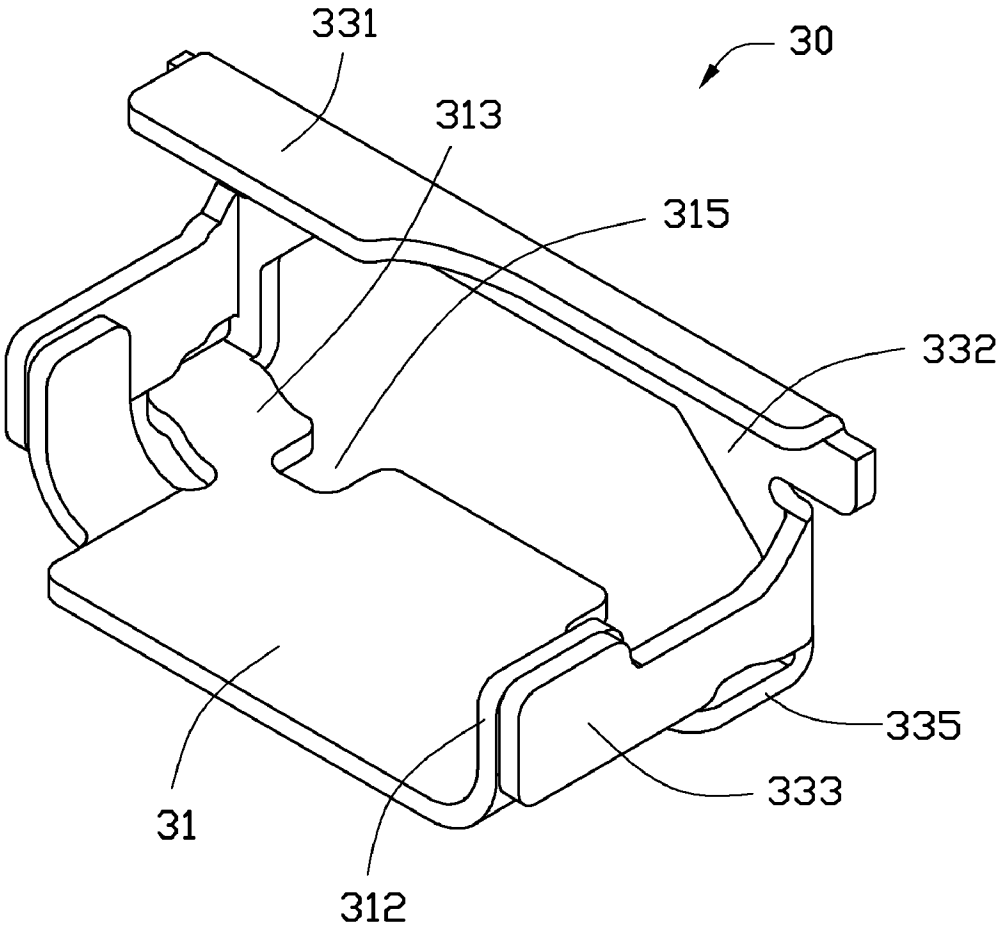
FIG. 2 is an enlarged, isometric view of the retaining clip of the electronic device of FIG. 1.
Figure 3:
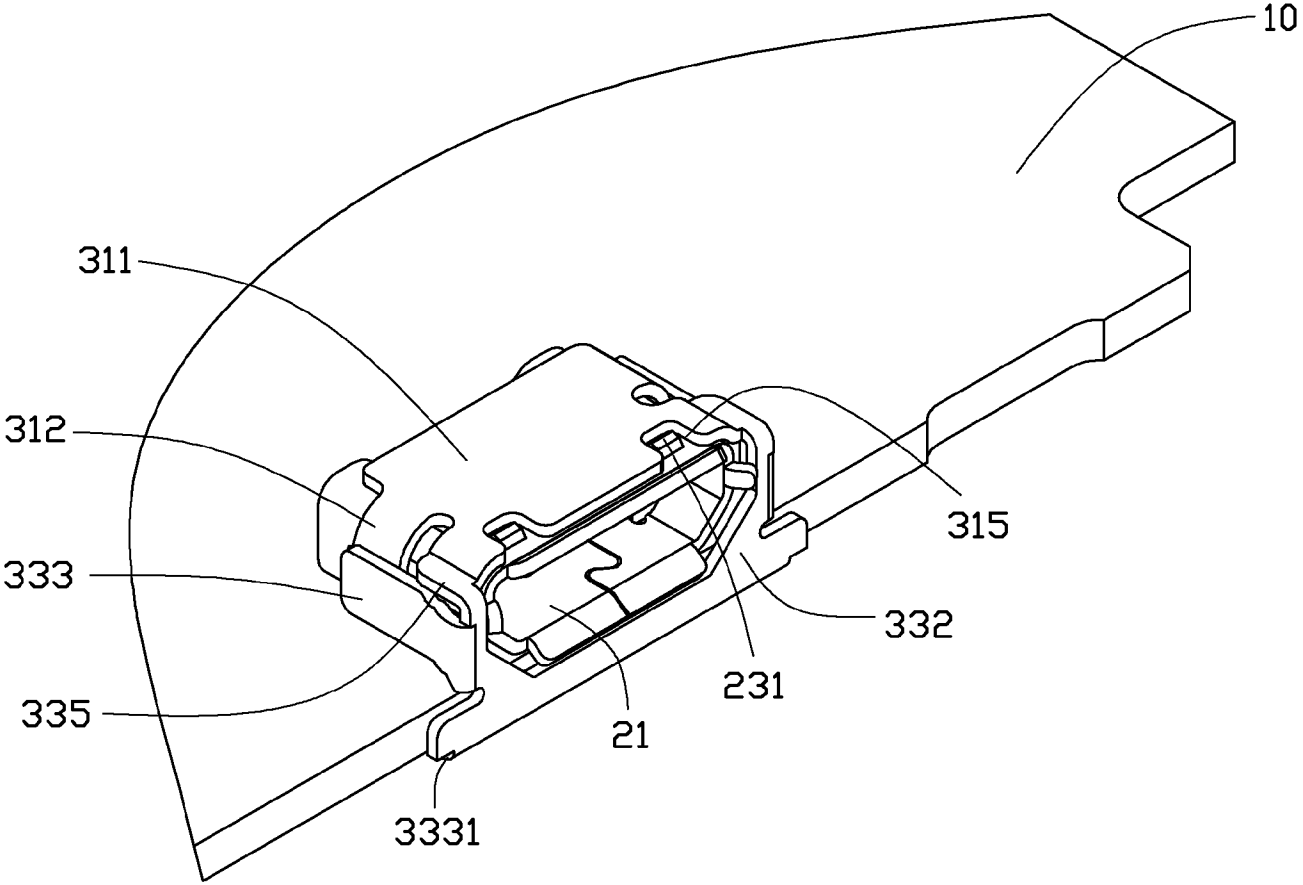
FIG. 3 is an assembled view of FIG. 1, showing the retaining clip attached to the electronic device.
Figure 4:
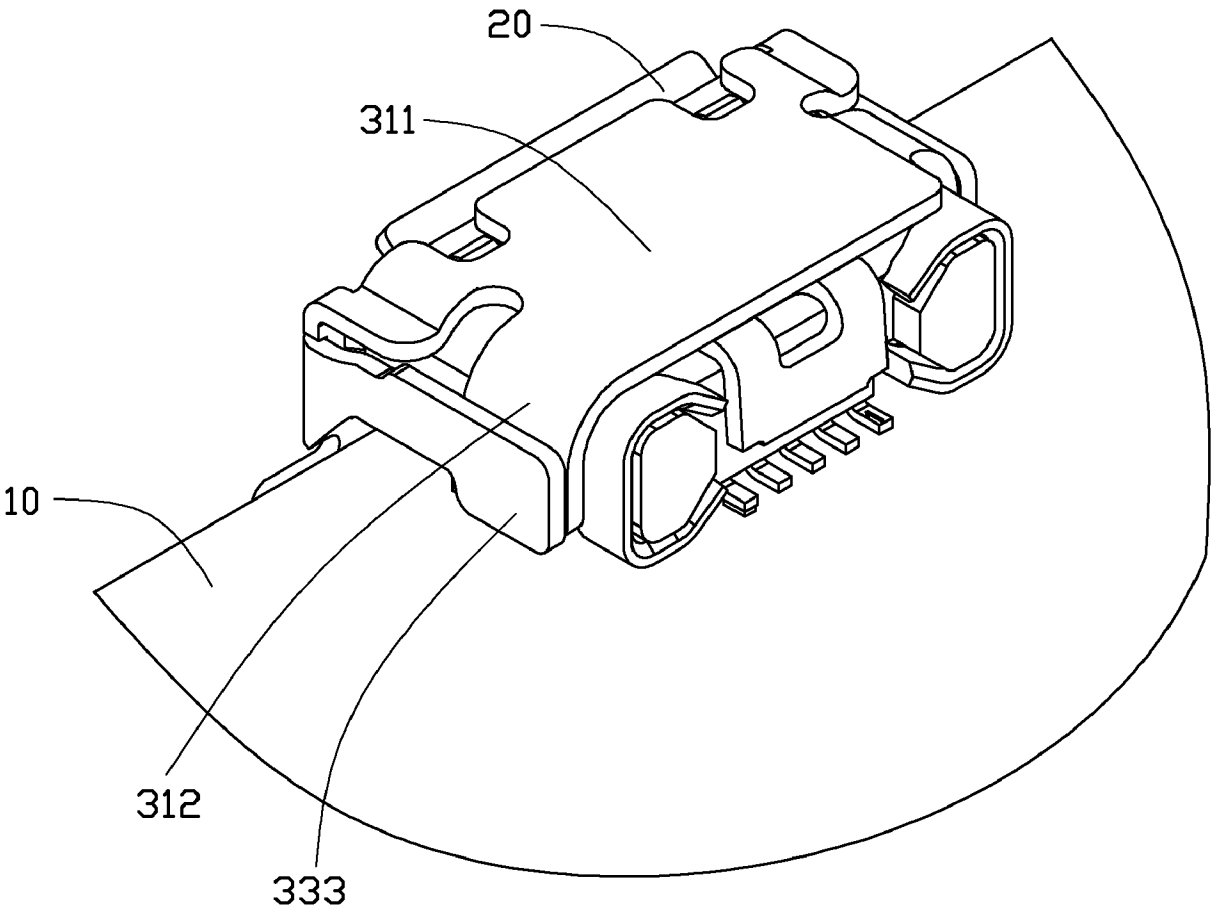
FIG. 4 is similar to FIG. 3, but shown from another aspect.

Referring to FIG. 1, a retaining clip 30 is used for holding a connecter 20 on a printed circuit board (PCB) 10.

The connector 20 includes a top wall 23, a bottom wall 24, and two sidewalls 25. The top wall 23, the bottom wall 24 and the sidewalls 25 are integrally formed, and cooperatively define a port 21. A plurality of blocks 231 extend from the top wall 23. Two tongues 251 respectively extend from a distal end of the top wall 23 and the bottom wall 24. Two tabs 252 respectively extend from distal ends of opposite sidewalls 25. The tongues 251 and the tabs 252 are positioned around the port 21. The bottom wall 24 is mounted to the PCB 10 by, e.g. surface mounding technology (SMT).

The retaining clip 30 is metal, and may be formed from, for example, sheet metal. The retaining clip 30 includes a cover plate 31 and a clamping plate 33. A bent portion 312 extends from each of two opposite sides of the cover plate 31. The bent portions 312 are for mounting the cover plate 31 to the clamping plate 33. An extending portion 313 extends from each of two opposite sides of the cover plate 31. Each bent portion 312 is adjacent to a corresponding extending portion 313. A plurality of cutouts 315 is defined at one side of the cover plate 31 corresponding to the blocks 231. The clamping plate 33 includes a main portion 331. The main portion 331 is substantially L-shaped, and includes a vertical portion and a horizontal portion connected to each other. The horizontal portion of the main portion 331 is parallel to the cover plate 31. Two angled portions 332 extend from one side of the vertical portion of the main portion 331. The angled portions 332 are coplanar with the vertical portion of the main portion 331 and are oriented at an obtuse angle relative to the vertical portion of the main portion 331. A distal end of each angled portion 332 is branched to form an arm 333 and a finger 335. Each arm 333 is fixed to a corresponding bent portion 312. The fingers 335 abut against the extending portions 313. An opening 34 is defined between the cover plate 31 and the clamping plate 33.

In assembly, firstly, the opening 34 is aligned with the port 21 of the connector 20 mounted to the PCB 10. Then, the retaining clip 30 is placed around the connector 20. The cover plate 31 abuts against the top wall 23. The cutouts 315 receive the blocks 231. The bent portions 312 contact the sidewalls 25. The tongues 251 and the tabs 252 extend from the opening 34 of the retaining clip 30. The main portion 331 is clamped at the PCB 10. Thus, the assembly of the retaining clip 30 is finished. The fingers 335 abut against the extending portions 313 to reduce the opening 34 to deform. Since the main portion 331 is clamped at the peripheral edge of PCB 10, the retaining clip 30 steadily holds the connector 20 to the PCB.

It is to be understood, however, that even though numerous characteristics and advantages of the present embodiments have been set forth in the foregoing description, together with details of assembly and function, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A combination comprising:

a connector;

a printed circuit board, a retaining clip holding the connector to the printed circuit board, the retaining clip comprising:

a cover plate including two bent portions respectively extending from opposite sides of the cover plate;

a clamping plate including a main portion and two angled portions connected to the main portion, a distal end of each angled portion branched to form an arm and a finger, each arm fixed to a corresponding bent portion, the cover plate and the arms surrounding the connector, and the main portion clamping a peripheral edge of the printed circuit board.

2. The combination of claim 1, wherein the main portion is substantially L-shaped, and includes a vertical portion and a horizontal portion connected each other, and the horizontal portion is parallel to the cover plate.

3. The combination of claim 2, wherein the two angled portions extend from one side of the vertical portion, the angled portions are coplanar with the vertical portion and are oriented at an obtuse angle relative to the vertical portion.

4. The combination of claim 3, wherein an extending portion extends from each of opposite sides of the cover plate, each finger is connected to a corresponding arm, and abuts against a corresponding extending portion.

5. An electronic device comprising:

a connector;

a printed circuit board, the connector mounted to the printed circuit board;

a retaining clip holding the connector to the printed circuit board, the retaining clip comprising a cover plate and a clamping plate connected to the cover plate, the clamping plate including a main portion and two angled portions connected to the main portion, a distal end of each angled portion branched to form an arm and a finger, and the main portion clamping a peripheral edge of the printed circuit board.

6. The electronic device of claim 5, wherein the main portion is substantially L-shaped, and includes a vertical portion and a horizontal portion connected each other, and the horizontal portion is parallel to the cover plate.

7. The electronic device of claim 6, wherein the two angled portions extend from one side of the vertical portion, the angled portions are coplanar with the vertical portion and are oriented at an obuse angle relative to the vertical portion.

8. The electronic device of claim 7, wherein an extending portion extends from each of opposite sides of the cover plate, each finger is connected to a corresponding arm, and abuts against a corresponding extending portion.

* * * * *